US009108101B2

(12) United States Patent
Gilson

(10) Patent No.: US 9,108,101 B2
(45) Date of Patent: Aug. 18, 2015

(54) SNOWBOARD

(71) Applicant: Nicholas Gilson, Winfield, PA (US)

(72) Inventor: Nicholas Gilson, Winfield, PA (US)

(73) Assignee: Gilson Boards, LLC, Winfield, PA (US)

( * ) Notice: Subject to any disclaimer, the term of this patent is extended or adjusted under 35 U.S.C. 154(b) by 0 days.

(21) Appl. No.: 14/058,838

(22) Filed: Oct. 21, 2013

(65) Prior Publication Data

US 2014/0110910 A1 Apr. 24, 2014

Related U.S. Application Data

(60) Provisional application No. 61/795,547, filed on Oct. 19, 2012.

(51) Int. Cl.

| | |
|---|---|
| ***A63C 5/04*** | (2006.01) |
| ***A63C 10/00*** | (2012.01) |
| ***A63C 5/03*** | (2006.01) |
| ***A63C 5/048*** | (2006.01) |
| ***A63C 5/044*** | (2006.01) |

(52) U.S. Cl.

CPC ... *A63C 5/04* (2013.01); *A63C 5/03* (2013.01); *A63C 5/044* (2013.01); *A63C 5/0485* (2013.01); *A63C 10/00* (2013.01)

(58) Field of Classification Search

CPC ..... A63C 5/03; A63C 5/04; A63C 5/0417; A63C 5/0422; A63C 5/0428; A63C 5/0434; A63C 5/044; A63C 5/048; A63C 5/0485

USPC ..... 280/601, 602, 608, 609, 11.18, 28

See application file for complete search history.

(56) References Cited

U.S. PATENT DOCUMENTS

| | | | | | |
|---|---|---|---|---|---|
| 1,998,702 | A | * | 4/1935 | Boline | 280/609 |
| 2,950,701 | A | * | 8/1960 | De Stefani | 440/52 |
| 3,027,575 | A | * | 4/1962 | Fortin | 441/68 |
| 3,077,617 | A | * | 2/1963 | Steffel | 441/68 |
| 3,099,025 | A | * | 7/1963 | Merkley et al. | 441/68 |
| 3,304,095 | A | * | 2/1967 | Carlton | 280/609 |
| 3,381,972 | A | * | 5/1968 | Miller | 280/608 |
| 3,503,621 | A | * | 3/1970 | Schmidt et al. | 280/610 |
| 3,871,671 | A | * | 3/1975 | Bildner | 280/608 |
| 4,083,577 | A | * | 4/1978 | Ford | 280/609 |
| RE29,659 | E | * | 6/1978 | Bildner | 280/608 |
| 4,305,603 | A | * | 12/1981 | Muller et al. | 280/607 |
| 4,340,241 | A | * | 7/1982 | Crocket | 280/609 |
| 4,433,855 | A | * | 2/1984 | Wyke | 280/609 |
| 4,509,771 | A | * | 4/1985 | Nussbaumer | 280/609 |
| 4,524,984 | A | * | 6/1985 | Axelson | 280/18 |
| 4,603,870 | A | * | 8/1986 | Monreal | 280/18 |
| 4,608,023 | A | * | 8/1986 | Williams | 441/68 |
| 4,795,184 | A | * | 1/1989 | Diard et al. | 280/609 |
| 5,052,963 | A | * | 10/1991 | Johnson, III | 441/68 |
| 5,340,144 | A | * | 8/1994 | Eleneke | 280/609 |
| 5,462,304 | A | * | 10/1995 | Nyman | 280/609 |
| 5,580,078 | A | * | 12/1996 | Vance | 280/608 |

(Continued)

*Primary Examiner* — Hau Phan
*Assistant Examiner* — Jacob Meyer
(74) *Attorney, Agent, or Firm* — Ropes & Gray LLP

(57) ABSTRACT

The disclosure herein is directed toward systems and methods for supporting a person and enabling motion of a person across a surface of snow can while satisfying the countervailing requirements of increasing surface area for weight-carrying capacity on soft snow and reducing the opposing forces, like for example drag and friction, in hard snow. More specifically, a snowboard with improved rider support, increased speed and enhanced safety performance.

12 Claims, 6 Drawing Sheets

(56) References Cited

U.S. PATENT DOCUMENTS

| | | | | |
|---|---|---|---|---|
| 6,062,585 | A * | 5/2000 | Hess | 280/608 |
| 6,193,244 | B1 * | 2/2001 | Vance | 280/14.22 |
| 6,224,085 | B1 * | 5/2001 | Cruz | 280/609 |
| 6,276,699 | B1 * | 8/2001 | Simmons et al. | 280/28 |
| 6,382,658 | B1 * | 5/2002 | Stubblefield | 280/609 |
| 6,394,483 | B2 * | 5/2002 | Stubblefield | 280/602 |
| 6,533,625 | B1 * | 3/2003 | Taylor | 441/68 |
| D473,488 | S * | 4/2003 | Mallette et al. | D12/7 |
| 6,974,139 | B2 * | 12/2005 | Lund | 280/28 |
| 7,073,810 | B2 * | 7/2006 | Wilson | 280/609 |
| 7,111,864 | B2 * | 9/2006 | Molg | 280/609 |
| 7,219,916 | B2 * | 5/2007 | Olson | 280/609 |
| 7,510,206 | B2 * | 3/2009 | Walker | 280/600 |
| 7,841,089 | B2 * | 11/2010 | Roberts et al. | 29/897.2 |
| 7,900,950 | B2 * | 3/2011 | Riepler et al. | 280/602 |
| 8,020,887 | B2 * | 9/2011 | Riepler et al. | 280/602 |
| 8,246,070 | B2 * | 8/2012 | Lin | 280/602 |
| 8,556,289 | B2 * | 10/2013 | Luthardt | 280/609 |
| 2002/0105166 | A1 * | 8/2002 | Lemieux | 280/609 |
| 2003/0151215 | A1 * | 8/2003 | Stief et al. | 280/14.21 |
| 2004/0100068 | A1 * | 5/2004 | Restani | 280/610 |
| 2004/0262885 | A1 * | 12/2004 | Wilson | 280/609 |
| 2005/0127638 | A1 | 6/2005 | Feichtlbauer et al. | |
| 2005/0212261 | A1 * | 9/2005 | Molg | 280/609 |
| 2006/0082089 | A1 * | 4/2006 | Rejtano | 280/87.042 |
| 2006/0097484 | A1 * | 5/2006 | Walker | 280/600 |
| 2007/0205583 | A1 * | 9/2007 | Schary et al. | 280/609 |
| 2008/0293506 | A1 * | 11/2008 | Northam | 472/90 |
| 2009/0206564 | A1 * | 8/2009 | Lin | 280/14.22 |
| 2010/0171288 | A1 * | 7/2010 | Nicosia et al. | 280/609 |
| 2011/0204596 | A1 * | 8/2011 | McLeod et al. | 280/609 |
| 2012/0032417 | A1 * | 2/2012 | Mantegazza | 280/609 |

* cited by examiner

SNOWBOARD

CROSS-REFERENCE TO RELATED APPLICATIONS

This application claims priority to U.S. application Ser. No. 61/795,547 entitled "Snowboard" naming Nicholas James Gilson as inventor and filed Oct. 19, 2012, the contents being incorporated herein by reference in their entirety.

TECHNICAL FIELD

The systems and methods described herein relate to sporting equipment. Specifically, snowboards and other systems and methods for enabling motion of a person across a surface of snow.

BACKGROUND

Sportsmen and engineers have designed different types of snowboards to travel over the surface of the snow. Snowboards travel differently than skis and sleds. In particular, snowboards allow users to lift up on or tilt onto an edge of the board and use the force of the board's edge against the snow surface to turn direction. This type of turning is called carving and it essentially allows the skilled snowboarder to make tight radius turns. Unlike with skis, the snowboarder positions his or her feet transverse to the longitudinal axis of the board. This means that the snowboarder must lean forward or backwards to tilt the board on to one of its edges. This takes quite a bit of skill to achieve, but the benefit is that the snowboard turns using a process that keeps the velocity of the board, both speed and direction, aligned with the turned patch of the snowboard. In contrast, turning without rising on to an edge, maintains the full wide bottom surface of the snowboard against the snow road forces the rider to essentially drag the bottom surface of the board until the snowboard points in the proper direction. This manner of turning is called skidding. Skidding the board slows the rider because the frictional force of the board against the snow is not aligned with the direction of travel and therefore results in a strong frictional stopping force. Frictional forces between the board and snow surface can make riding more difficult and less fun.

Engineers and sportsmen have endeavored to reduce the frictional forces that slow and make less stable the movement of a snowboard across the snow.

The interaction between the board and the snow impacts the performance of the board and rider. For example, U.S. Pat. No. 8,356,822 describes engagement devices that can attach to the bottom of a snowboard to change how it engages with the snow and performs. U.S. Pat. No. 6,193,244 discusses a snowboard having two edges on the bottom surface for contacting the snow to reduce skidding.

Still there remains a need for improved systems and devices for improving and altering the performance of snowboards.

SUMMARY

In general, the system is designed to support the weight of the user and to provide motion across the surface of snow. The weight-carrying capacity of snow increases with compaction. Soft, uncompact snow has a lower weight-carrying capacity than hard, compact snow. When the weight-carrying capacity of snow is exceeded, the snow compacts until it reaches the requisite weight-carrying capacity to support the applied weight. The area of contact between the system and the snow is calculated by multiplying the width of contact between the system and the snow by the length of contact between the system and the snow. The system carries the weight of the user by transferring the weight to the snow surface across the area of contact. The maximum operating speed of the system is, in part, determined by magnitude of opposing forces that occur at the area of contact between the system and the snow surface. The opposing forces may be generated by friction, drag or other forces that oppose the primary direction of travel while the system is in use. Opposing forces have a negative impact on the maximum speed of the system.

Conventional systems are designed for use in one of either soft snow or hard snow. In soft snow, it is desirable for the weight of the user to be supported on a large area of contact between the system and the snow, without little or no compaction required. The large area of contact places more snow under the system to support the weight of a user; it allows the user to "glide" across the surface of snow without sinking into the snow, which would increase the magnitude of opposing forces. In hard snow, it is desirable for the weight of the user to be supported on a small area of contact between the system and the snow. The small area of contact between the system and the snow reduces the magnitude of opposing forces, such as an opposing frictional force, which, in part, contributes to an increased maximum speed of the system.

In the design of a conventional system, the width of contact between the system and the snow is fixed. Therefore, it is not possible to substantially increase or decrease the width of contact in response to varying snow conditions. Consequently, many expert users carry more than one system; one wide system for soft snow conditions and one other narrow system for hard snow conditions. The soft snow system is significantly wider than the hard snow system. The increased width of the soft snow system increases the horizontal surface area, and increases the normal force supporting the user. A conventional system that is designed for soft-snow causes unnecessary drag and friction when operated on hard snow.

In addition, when operating a conventional system, the user must be careful not to operate the system in a substantially flat position. A flat position is characterized by two opposing edges of the system touching the snow simultaneously. Often, the two edges are oriented perpendicular to the primary direction of travel. When the standard system is operated in a flat position, it has the potential to pitch and/or yaw, causing an edge of the system to unintentionally catch and stop in the snow, which generally results in the rider falling down. This phenomenon is sometimes called "catching an edge" and is potentially dangerous for the rider.

The snowboards described here address the countervailing requirements of increasing area for weight-carrying capacity on soft snow and reducing the opposing forces in hard snow. Moreover, these snowboards reduce the likelihood of unintentionally catching an edge in the snow.

The system and methods disclosed herein support the weight of the user and enable motion at a high maximum speed on snow while satisfying the countervailing requirements of increasing weight-carrying capacity reducing opposing forces. Among other features, the systems includes a contoured lower surface that sinks lower in soft snow and rises higher in hard snow. The lower surface has at least two rails and a recessed region, which provide additional surface area for transferring weight to the snow. The amount of area contacting the snow adjusts based on, in part, the rider's speed, weight and the current snow conditions. The rails on the lower surface are sloped up toward the periphery of the system, which lifts the edges up from the snow surface and thereby reduces the likelihood of unintentionally catching an edge in the snow.

More specifically, the systems and methods described herein include, among other things, snowboards having a board with an upper surface and a lower surface and a first and second end. Typically, both the first and second ends are curved upward, to lift the ends of the board off the surface of the snow, as commonly done with snowboards. The upper surface has locations for a first binding and a second binding to allow the bindings to be arranged transverse to a longitudinal axis extending through the first and second ends. The lower surface has a first and a second rail extending along the longitudinal axis and being separated by a recess extending along the longitudinal axis. The rails and the recess all have a width, as measured transverse to the longitudinal axis of the board. The width of the recess is typically, but not necessarily, greater than the width of each respective rail and the first and second rails and the recess extend across the width of the bottom surface and substantially the length of the bottom surface of the board.

Optionally, the snowboard may have first and second rails that have respective interior shoulder walls having an at least 30° inclination from an axis parallel to a beam of the board. Further optionally, the snowboard may have first and second rails have a width substantially equal to one quarter the width of the bottom surface of the board.

Typically, but optionally, the snowboard may have one or more bindings for gripping a boot of a rider, and the binding may be arranged to position a heel of the boot over one rail and a toe of the boot over a different rail.

The snowboard may have first and second rails that have surfaces for contacting the snow, the surfaces being tapered to narrow in thickness from the recess to the peripheral edge of the board. Optionally, when the board rests against a flat surface, the peripheral edge of the board is raised above the flat surface. The peripheral edge may be raised between about 1 mm and 8 mm above the flat surface, or any other suitable distance.

In manufacture, the snowboard may have first and second rails that comprise modular bodies for being secured to the bottom surface of the board. Alternatively, the snowboard may have first and second rails that comprise rails integrally formed as part of the bottom surface of the board.

Further optionally, the snowboard, under typical operating conditions, has rails with a width selected to support the weight of a user, and thereby have the recessed surface apply a force less than the weight of the user, which may include no substantial force, to the surface of the snow, such that the center of the board applies little or no force to the surface of the snow and frictional forces generated against the center of the board are reduced or eliminated.

BRIEF DESCRIPTION OF THE DRAWINGS

The foregoing and other objects and advantages of the invention will be appreciated more fully from the following further description thereof, with reference to the accompanying drawings wherein.

DESCRIPTION OF THE ILLUSTRATED EMBODIMENTS

Certain illustrative embodiments will now be described, including a snowboard that supports the weight of the user and enables the user to move across the surface of snow at a high speed while satisfying the countervailing requirements of increasing weight-carrying capacity and reducing opposing forces, such as opposing frictional forces. However, it will be understood by one of ordinary skill in the art that the systems and methods described herein can be adapted and modified for other suitable applications and that such other additions and modifications will not depart from the scope hereof.

In certain embodiments, the snowboard has a bottom surface having two rails. The two rails run the length, or substantially the length, of the snowboard and these two rails are separated by a recess, so that the two rails are arranged to place one along each side of the snowboard. The rails have a bottom surface that contacts the snow. Under certain operating conditions, such as when the snow is compact and firm enough to prevent or reduce the rails from sinking more than a few millimeters into the snow, the snowboard moves over the snow with the rails in contact with the snow surface and the recessed portion of the board spaced away from the compact snow surface. Optionally, the rails may have a tapered surface. The taper may progress from the interior side of the rail adjacent to the recess toward the peripheral edge of the board. The taper spaces the peripheral edge of the board away from a flat surface on which the rails may rest. The tapered surfaces are examples of a contoured lower surface having dual rails.

Among other features, the contoured lower surface may sink lower in soft snow and ride higher in hard snow. The amount of area contacting the snow adjusts based on, in part, the rider's speed, weight and the snow conditions. The rails on the lower surface may optionally be sloped up toward the periphery of the board and may reduce the likelihood of unintentionally catching an edge in the snow, and thereby improve stability.

DETAILED DESCRIPTION

Figure 1:
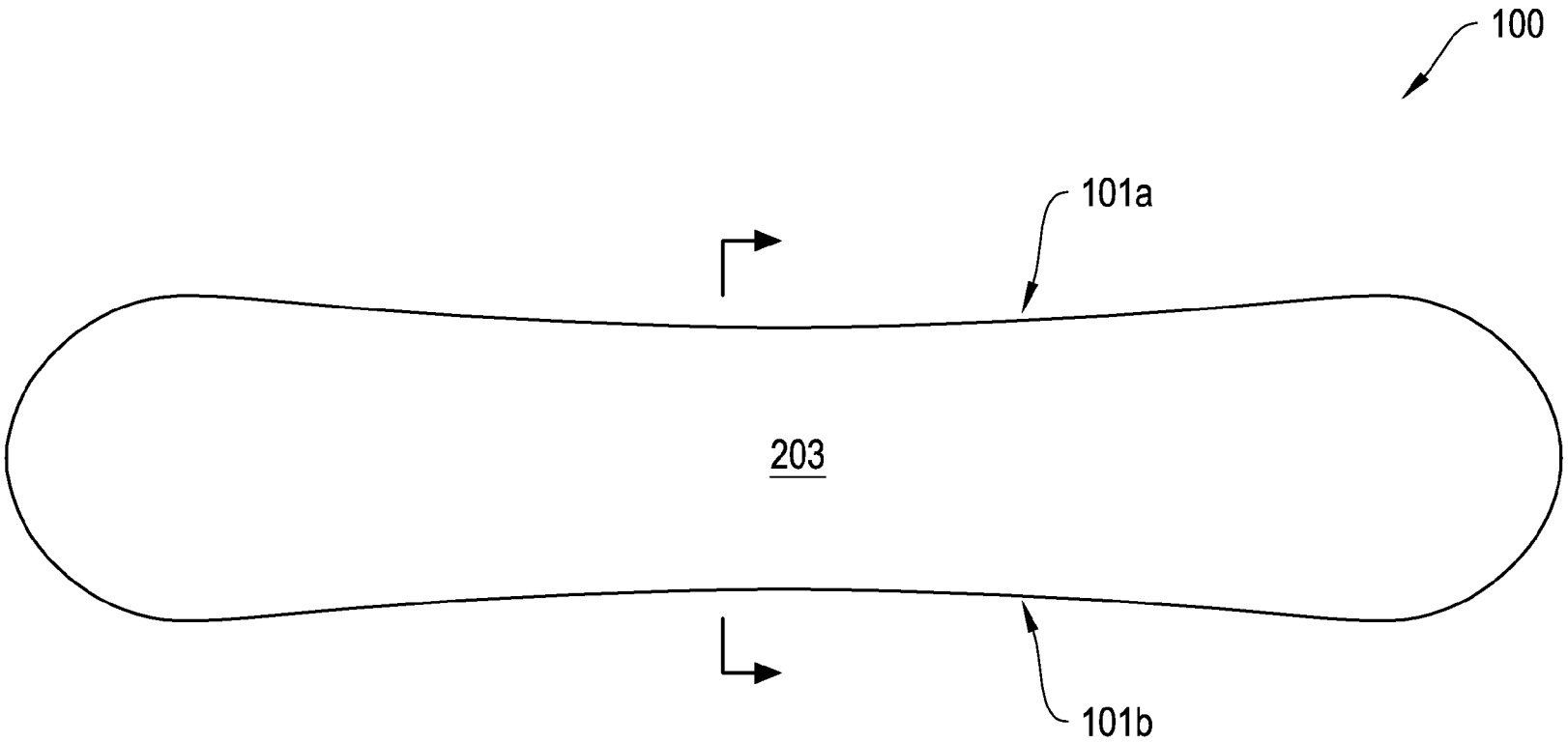
FIG. 1 depicts prior art snowboard designed to support and to enable motion for a person on snow.

FIG. 1 depicts a prior art snowboard 100 designed to support the weight of a person and to enable motion on snow. The snowboard 100 contains at least one rigid element, wherein each rigid element has an upper surface (not shown), a lower surface 203 and one or more stiffened peripheral edges 101(*a*) and (*b*). Edges 101(*a*) and (*b*) are located on left and right ends and, in some embodiments, may line the entire periphery of the system. Edges 101 may be made of metal, alloy or any other suitable material.

Figure 2:
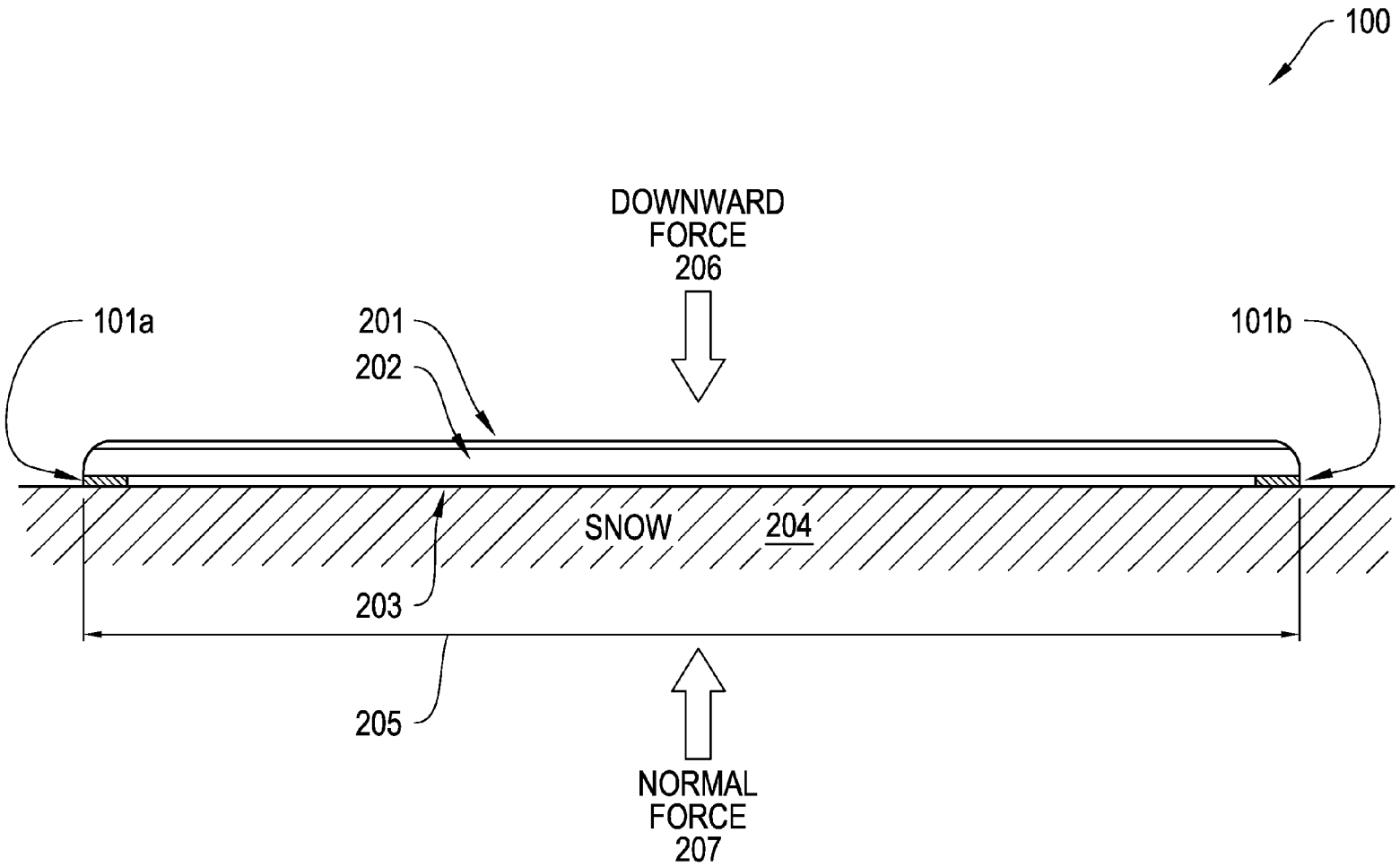
FIG. 2 depicts a cross-sectional view of a prior art snowboard.

FIG. 2 depicts a cross-sectional detail of the prior art snowboard of FIG. 1. The snowboard 100 has an upper surface 201, a lower surface 203, and a plurality of inner-layers 202 positioned between the upper surface 201 and lower surface 203. Edges 101(*a*) and (*b*) are located on left and right ends, respectively. The lower surface 203 rests on the snow surface 204. The downward force 206 is transferred through the system 100 and is balanced by the normal force 207.

Upper surface 201 may be made of a glossy material, which serves as a medium to place graphic designs and also a UV protectant layer. Lower surface 203 is typically a polyethylene and serves to reduce friction between the bottom of the system and the surface of travel. Inner-layers 202 are made of hardwood placed in between layers of fiberglass.

During operation, the snowboard 100 reaches a physical equilibrium state wherein the normal force 207 is equal to downward force 206. The downward force 206 is determined, in part, by weight of the person on the snowboard 100. The normal force 207 is distributed across the snow 204 on an area snow-to-board contact (not shown), which is determined, in part, by the width of snow-to-board contact 205. For the prior art snowboard, the width of contact 205 remains constant even as the downward force 206 increases.

Figure 3:
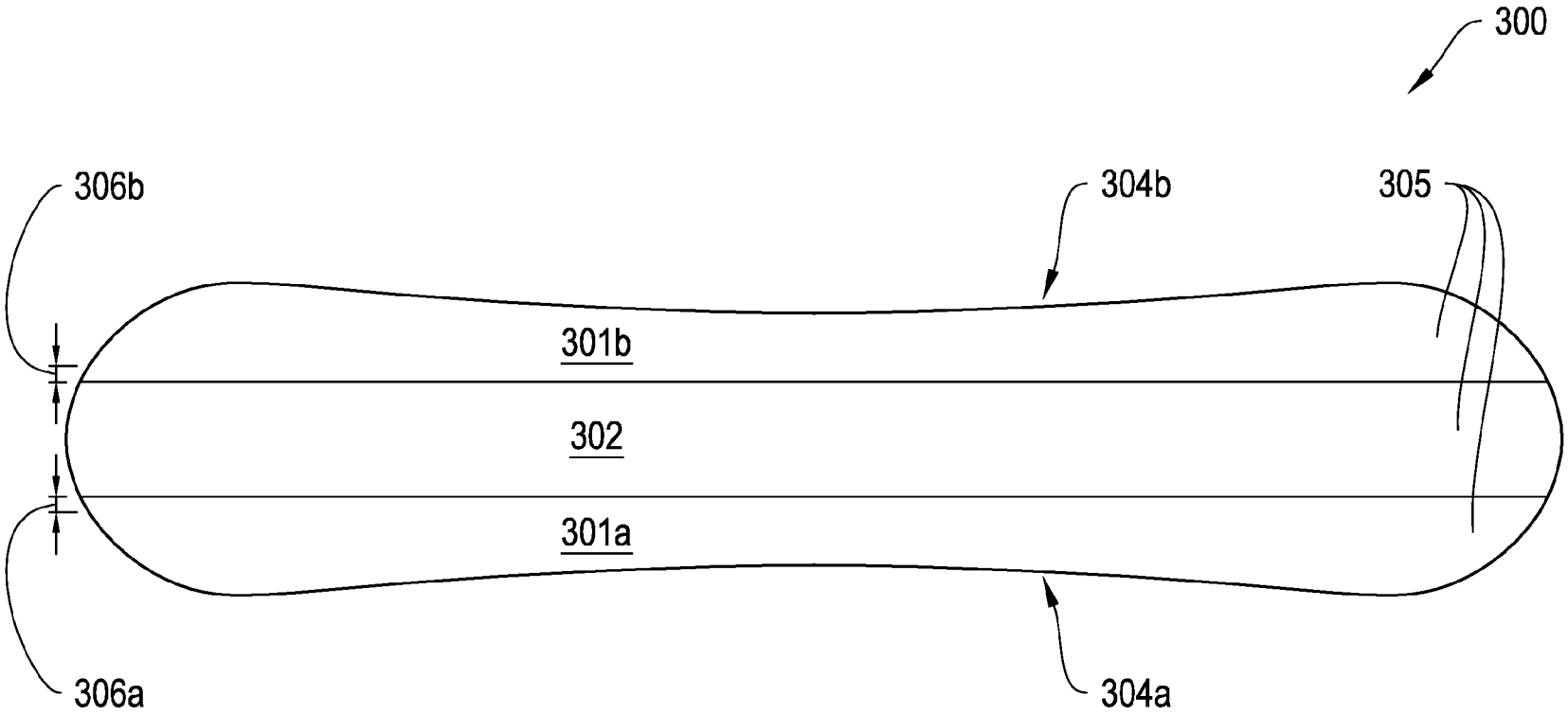
FIG. 3 depicts one embodiment of a snowboard designed to support and to enable motion for a person on snow.

FIG. 3 depicts one embodiment of the snowboards described herein. Specifically, FIG. 3 depicts the lower surface of a snowboard having two rails separated by a recess. As shown, the snowboard 300 has an upper surface (not shown), a lower surface 305, and one or more stiffened peripheral edges 304(*a*) and (*b*), which are located on the left side and right side of the board, respectively. The peripheral edges 304*a* and 304*b* may form a single edge that surround the full periphery of the snowboard 300. Alternatively, in other embodiments, the edges 304*a* and 304*b* are separate edges on opposing longitudinal sides of the board. The lower surface 305 is continuous across the rails 301 and a recessed region 302 is arranged between the two rails 301*a* and 301*b*. In some embodiments, the board is laminated from a series of layers. Typically the layers are wood, fiberglass and/or plastic, although other materials may be employed. These form the inner structure of the snowboard 300 and the inner layers (not shown) may be contoured in a shape that is similar to that of the lower surface 305. In other embodiments, the inner layers (not shown) may be formed as a generally flat board and the rails 301 may be distinct components of the system that are attached separately to the lower surface 305. In either case, the contour of the lower surface 305 may be similar. When in use, the system makes contact with the snow across the width of contact 306.

The dimensions of the snowboard 305 may vary, and typically will be between 90-170 cm in length as measured along a longitudinal axis extending along the length of the snowboard 305 and between 20-30 cm in width as measured along a beam axis extending perpendicular to the longitudinal axis. The snowboard 305 has a generally hourglass shape, with curved lateral sides. Typically, both the front end and the back end are curved upward to lift the ends of the snowboard off the surface of eh snow when the lower surface 305 is placed on the snow surface. Other dimensions and shapes may be used without departing from the scope of the invention.

Figure 4:
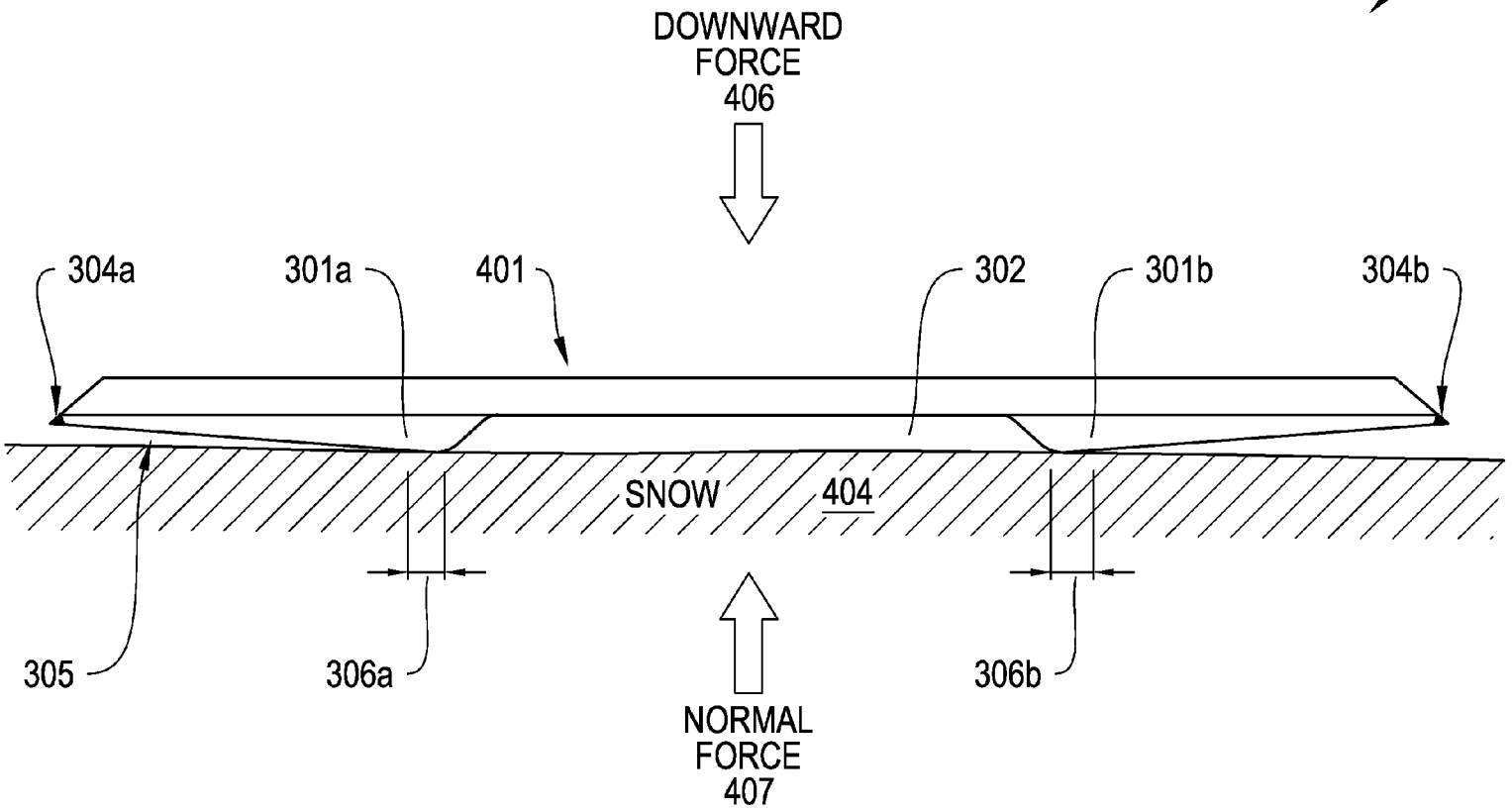
FIG. 4 depicts a cross-sectional view of one embodiment of a snowboard as described herein.

FIG. 4 depicts a cross-sectional detail of one embodiment of the snowboards described herein. According to one embodiment, system 300 has an upper surface 401 and a lower surface 305. The lower surface 305 is continuous across the left rail 301(*a*), the recessed region 302 and the right rail 301(*b*). Stiffened peripheral edge 304(*a*) and edge 304(*b*) are located at the left end and right ends, respectively. The downward force 406 is determined, in part, by weight of the person using the snowboard. The normal force 407 is distributed across the snow 404 on an area snow-to-board contact (not shown), which is determined, in part, by the width of snow-to-board contact 305. As the downward force 406 increases, the width of contact 305 may also increase. Likewise, as the downward force 406 decreases, the width of contact 305 may also decrease.

In operation, the snowboards described herein adjust to varying snow conditions. In soft snow, the board sinks lower in the snow thereby increasing the width of contact 306, which increases the normal force supporting the rider. In some soft snow conditions, the width of contact 306 may be large enough to include the entire width of the lower surface 305, including the surface area of rails 301 and the recessed region 302. In hard snow, the snowboard may rise toward the top of the surface and thereby decrease the area of contact 306. In some hard snow conditions, the width of contact 306 may be small and may only include the peak of rails 301(*a*) and (*b*) and not the surface of the recessed region 302. For conditions in between the soft and hard, the amount of board-to-snow contact varies as needed, such that the downward force 406 is equal to the normal force 407.

Turning to FIGS. 3 and 4, the rails 301 run the length of the board. Thus, the length of contact is not altered relative to the conventional design but the width of contact is decreased. By keeping the length of contact between the system and the snow constant, and by decreasing the width of contact between the system and the snow, the claimed system is able to attain higher speeds on snow than a conventional system. Not to be bound by theory, but the snowboard having the two rails on the bottom surface, may be faster than a conventional snowboard. For the same physical principles that a pair of skis is faster than a standard snowboard of the same length, and a catamaran is faster than a mono-hull boat of the same length.

Also depicted in FIG. 4, the twin rails 301, may optionally not be rectangular in shape. Instead, they may be angled upwards from the peak of the rail towards the periphery of the board. Thus, the rails have a tapered surface that progresses from the interior of the board to the peripheral edge. This design feature raises the edges 304 up above the snow when the operator is initiating a turn while operating the snowboard. The raised edges allow the user to travel on width of contact 306, without fear of unintentionally catching an edge. The result is increased comfort and, in part, safety and stability at high speeds. To initiate a carving turn, the rider must rotate the claimed system slightly further than the conventional system, ensuring that any edge-to-snow contact is intentional.

Figure 5:
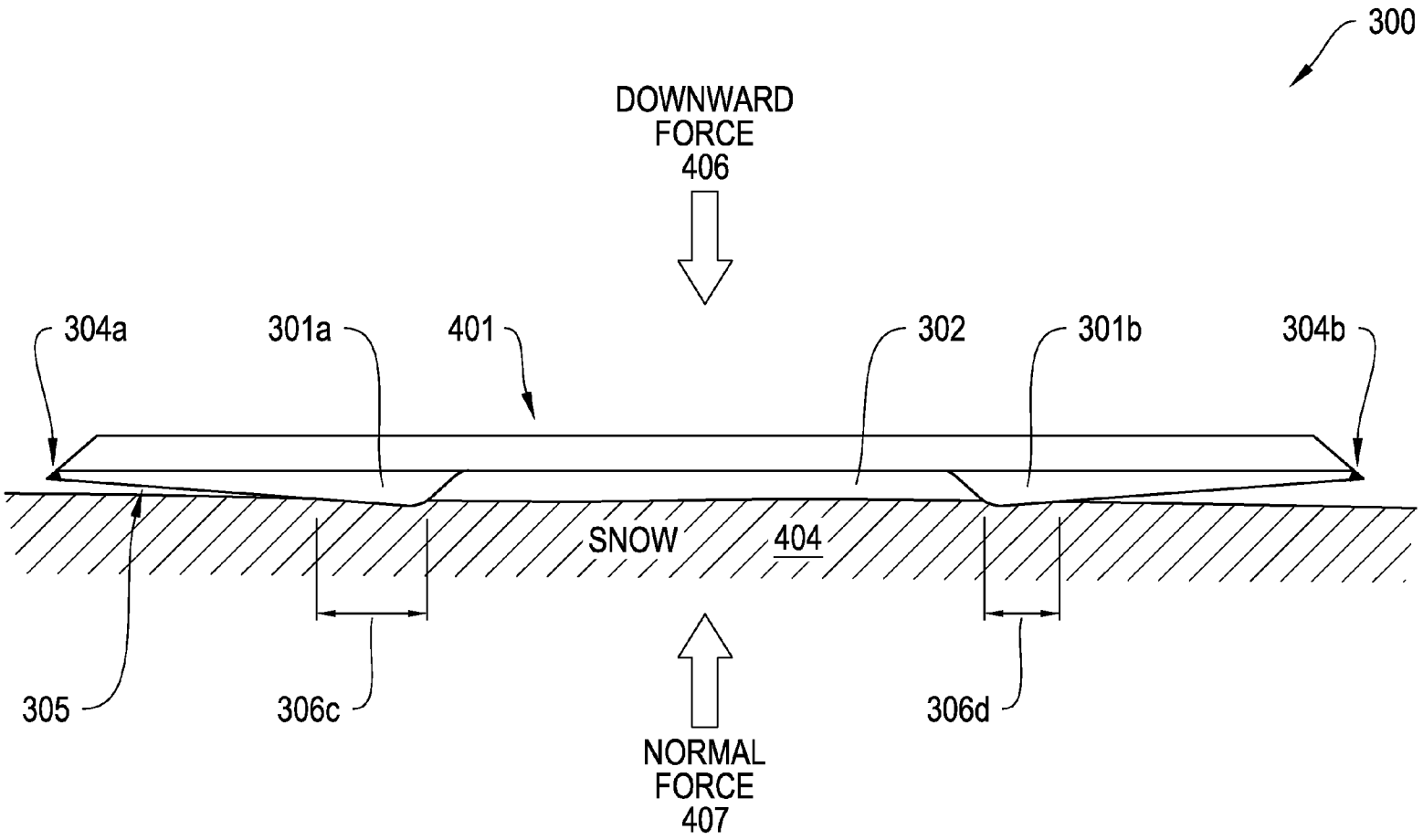
FIG. 5 depicts a cross-sectional view of a snowboard such as the snowboard in FIG. 4, and placed on a snow surface of less compact snow.

FIG. 5 depicts the snowboard of FIGS. 3 and 4 placed on a snow surface that is less firm and compact than the snow surface of FIG. 4. Specifically, FIG. 5 illustrates the snowboard 300 disposed over a snow surface 404. A force 406, typically the weight of the Rider, pushes the snowboard 300 against the snow surface 404. In the conditions represented by FIG. 5, the rails 301(*a*) and 301(*b*) press more deeply into the snow surface 404 than under the conditions depicted by FIG. 4. The areas of contact 306(*c*) and 306(*d*) of the rails 301(*a*) and 301(*b*) against the snow 404 are larger than the areas of contract 306(*a*) and 306(*b*) depicted in FIG. 4. In still less firm conditions, the snow 404 may contact the recessed region 302 and press against the snowboard 302, at the rails 301(*a*) and 301(*b*) and at the recessed regions.

Figure 6:
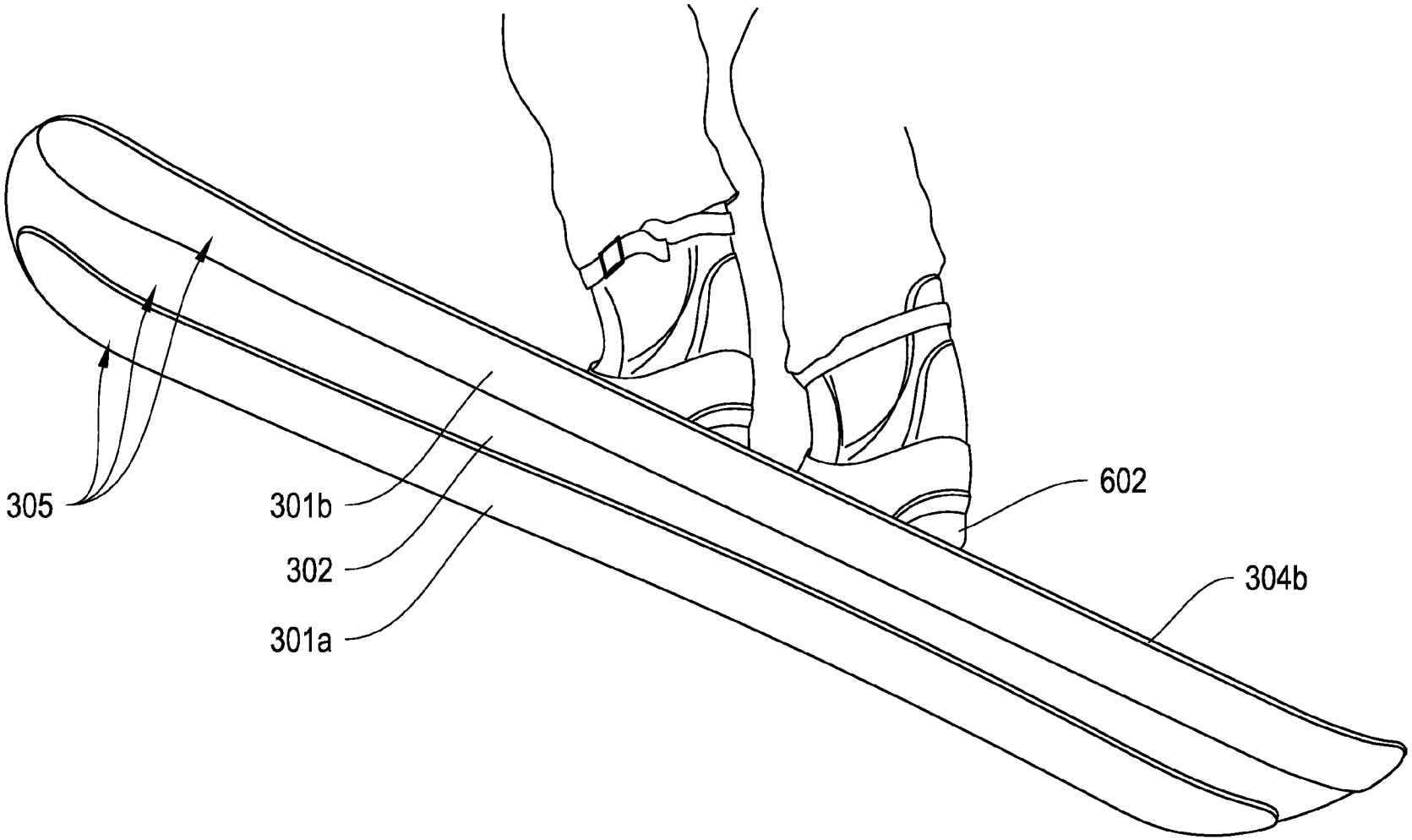
FIG. 6 depicts the lower surface of the snowboard of FIG. 3 having two rails, and partially shows a rider with bindings attached to the upper surface of the snowboard.

FIG. 6 depicts the lower surface 305 of the snowboard 300 and partially depicts binders and boots of a rider. As shown, the binders or bindings grip the rider's boot and hold the boot on the upper surface of the snowboard 300. The binding is arranged to position the heel of the boot 602 over one rail 301*b* and a toe of the boot (not shown) over a different rail 301*a*. To turn, the rider can lean forward or back to tip the snowboard 300 onto an edge 304 to carve a turn into the snow.

The manufacture of the disclosed snowboard may be accomplished employing methods that are familiar to those skilled in the art. For example, the layers of the disclosed snowboard may be constructed, in part, using a mold, which is designed having a shape consistent with the contours of the claimed system. Other example manufacturing methods may have an expandable bladder, placed in an enclosure with the layers of the system and the mold. As the bladder expands, it applies pressure to the layers, forcing them against the mold and imparting the contours of the mold. In some embodiments of a manufacturing system struts, made of wood, are used to help distribute the pressure from the bladder to the layers of the system. In other embodiments of a manufacturing method, the layers of the system may be pressed together using a pneumatic press, which applies pressure to the layers, forcing them against the opposing surface of the press and imparting the contours of the claimed system. In other embodiments, the layers of the system are attached to one another using adhesives, epoxy, or other suitable attachment systems.

Those skilled in the art will know or be able to ascertain using no more than routine experimentation, many equivalents to the embodiments and practices described herein. For example, the claimed system and the knowledge disclosed herein may be utilized to modify or to create systems designed to carry a person or objects across a surface of water, sand, or other materials. More specific example applications may include, among other things, snowboards, water skis, wake boards, kayaks, winder surfers, or paddle boards.

Accordingly, it will be understood that the invention is not to be limited to the embodiments disclosed herein, but is to be understood from the following claims, which are to be interpreted as broadly as allowed under the law.

The invention claimed is:

1. A snowboard, comprising a board having an upper surface and a lower surface and a first and second end, both the first and second ends being curved upward, the upper surface having locations for a first binding and a second binding to allow the bindings to be arranged transverse to a longitudinal axis extending through the first and second ends, and the lower surface having a first and a second rail extending along the longitudinal axis and being separated by a flat recess extending along the longitudinal axis, each rail having a tapered outer shoulder and a tapered inner shoulder, the rails being tapered to narrow a thickness of the respective rail from the recess to a peripheral edge of the board, to have the peripheral edge of the board substantially at a height of the recess, the rails and the recess each having a width measured transverse to the longitudinal axis and the width of the recess being greater than the width of each respective rail and the first and second rails and the recess extending the width of the bottom surface and extending substantially the length of the bottom surface.

2. The snowboard according to claim 1, where the first and second rails have respective interior shoulder walls having an at least 30° inclination from an axis parallel to a beam of the board.

3. The snowboard according to claim 1, wherein, the first and second rails have a width substantially equal to one quarter the width of the bottom surface.

4. The snowboard according to claim 1, further comprising a binding for gripping a boot of a rider, and wherein the binding is arranged to position a heel of the boot over one rail and a toe of the boot over a different rail.

5. The snowboard according to claim 1, wherein the first and second rails have surfaces for contacting the snow.

6. The snowboard according to claim 5, wherein when the board rests against a flat surface, the peripheral edge of the board is raised above the flat surface.

7. The snowboard according to claim 6, wherein the peripheral edge is raised between about 1 mm and 8 mm above the flat surface.

8. The snowboard according to claim 1, wherein the first and second rails comprise modular bodies for being secured to the bottom surface of the board.

9. The snowboard according to claim 1, wherein the first and second rails comprise rails integrally formed as part of the bottom surface of the board.

10. The snowboard according to claim 1, wherein, under typical operating conditions, the width of the rails is selected to support the weight of a user, and thereby have the recessed surface apply a force less than the weight of the user to the surface of the snow.

11. A method of manufacturing a snowboard, comprising providing a board having an upper surface and a lower surface and a first and second end, both the first and second ends being curved upward, arranging on the upper surface locations for a first binding and a second binding to allow the bindings to be arranged transverse to a longitudinal axis extending through the first and second ends, and forming on the lower surface a first and a second rail extending along the longitudinal axis and being separated by a flat recess extending along the longitudinal axis, each rail having a tapered outer shoulder and a tapered inner shoulder, the rails being tapered to narrow a thickness of the respective rail from the recess to a peripheral edge of the board, to have the peripheral edge of the board substantially at a height of the recess, wherein the rails and the recess each have a width measured transverse to the longitudinal axis and the width of the recess being greater than the width of each respective rail and the first and second rails and the recess extend the width of the bottom surface and extend substantially the length of the bottom surface.

12. The snowboard of claim 1, wherein the width of the recess is greater than the width of each respective rail over the length of the bottom surface.

* * * * *